US006417656B1

(12) United States Patent
Shirai

(10) Patent No.: US 6,417,656 B1
(45) Date of Patent: Jul. 9, 2002

(54) TEMPERATURE CHARACTERISTIC COMPENSATING CIRCUIT AND SEMICONDUCTOR INTEGRATED CIRCUIT HAVING THE SAME

(75) Inventor: Takahiro Shirai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/943,652

(22) Filed: Aug. 31, 2001

(30) Foreign Application Priority Data

Sep. 12, 2000 (JP) ..... 2000-276091

(51) Int. Cl.[7] ..... G05F 3/16; G05F 3/20
(52) U.S. Cl. ..... 323/316; 323/353; 323/907
(58) Field of Search ..... 323/353, 354, 323/907, 316, 315, 317

(56) References Cited

U.S. PATENT DOCUMENTS 4,479,708 A * 1/1984 Tokuda ..... 296/231
4,633,165 A * 12/1986 Pietkiewicz et al. ..... 323/314
5,886,515 A * 3/1999 Kelly ..... 323/313

* cited by examiner

*Primary Examiner*—Bao Q. Vu
(74) *Attorney, Agent, or Firm*—Ronin, Blacker & Daley

(57) ABSTRACT

A temperature characteristic compensating circuit is capable of carrying out temperature compensation of a signal that varies in proportion to absolute temperature by analog processing and without using a thermistor, to thereby enable use of a smaller IC. A first current source supplies a first current that is proportional to the absolute temperature and inversely proportional to the resistance value of a first resistor. A second current source supplies a second current that is inversely proportional to the resistance value of a second resistor. A first circuit carries out logarithmic compression of an input voltage using the first current as a bias current, and a second circuit carries out logarithmic expansion of the logarithmically compressed voltage using the second current as a bias current. The gain of the logarithmically expanded voltage relative to the input voltage is proportional to the ratio of the second current to the first current. As a result, a temperature characteristic compensating circuit that does not use an external thermistor but nevertheless gives a gain inversely proportional to absolute temperature can be formed.

7 Claims, 2 Drawing Sheets

TEMPERATURE CHARACTERISTIC COMPENSATING CIRCUIT AND SEMICONDUCTOR INTEGRATED CIRCUIT HAVING THE SAME

BACKGROUND OF THE INVENTION

1. Field of the Invention

The present invention relates to an improved temperature characteristic compensating circuit that uses analog processing to compensate for a temperature characteristic of a signal processing circuit of a photosensor used in a camera or a camera flash or the like, and an improved semiconductor integrated circuit that contains the temperature characteristic compensating circuit.

2. Description of Related Art

In an analog circuit, when logarithmically compressing the output of a photosensor using a diode and carrying out signal processing on the resulting output, due to the temperature dependence of the I-V (current-voltage) characteristic of the diode, the output voltage is proportional to the absolute temperature. The temperature characteristic of the output of the photosensor is thus compensated for using an external thermistor and an external resistor as shown in FIG. 3, and then the signal processing is carried out after that.

In FIG. 3, reference numeral 21 designates the photosensor, and 22 designates a diode that carries out logarithmic compression of the output current from the photosensor 21 and converts the current into a logarithmically compressed voltage in cooperation with an operational amplifier 23. Reference numeral 24 designates a diode, 25 an operational amplifier, and 26 a constant current source. The diode 24, the operational amplifier 25 and the constant current source 26 are for compensating for the dark current of the diode 22.

When the dark currents of the diodes 22 and 24 are equal, the output voltage after the dark current compensation is $(kT/q)\ln(Ip/Iref)$, wherein k represents Boltzmann's constant, T the absolute temperature, q a unit charge, Ip the photocurrent, and Iref the above-mentioned constant current.

Because the output is proportional to the absolute temperature T, before carrying out the signal processing, a gain that is inversely proportional to the absolute temperature T is applied using an external thermistor 27 and an external resistor 28, thus producing an output that does not vary with temperature.

Because the temperature compensation is carried out using the external thermistor 27 and the external resistor 28, external terminals 30 and 31 that are connected to an operational amplifier 29 of an IC (semiconductor integrated circuit) containing the photosensor 21 etc. are required, as shown in FIG. 3.

The IC is generally composed of transistors (including field effect transistors and diodes), resistors and capacitors. Incorporating a thermistor having a negative temperature characteristic into the IC is problematic, and hence an external thermistor has to be used.

If temperature characteristic compensation could be carried out without using an external thermistor, then the component mounting area could be reduced accordingly and external terminals would become unnecessary, resulting in a smaller IC.

SUMMARY OF THE INVENTION

It is an object of the present invention to provide a temperature characteristic compensating circuit that is capable of carrying out temperature compensation of a signal that varies in proportion to absolute temperature by analog processing and without using a thermistor, to thereby enable use of a smaller IC, and a semiconductor integrated circuit that contains the temperature characteristic compensating circuit.

In one aspect of the present invention, the temperature characteristic compensating circuit comprises a first current source that supplies a first current that is proportional to the absolute temperature and inversely proportional to the resistance value of a first resistor, a second current source that supplies a second current that is inversely proportional to the resistance value of a second resistor, a first circuit that carries out logarithmic compression of an input voltage using the first current as a bias current, and a second circuit that carries out logarithmic expansion of the logarithmically compressed voltage using the second current as a bias current. The gain of the logarithmically expanded voltage relative to the input voltage is proportional to the ratio of the second current to the first current. As a result of the above, a temperature characteristic compensating circuit that does not use an external thermistor but nevertheless gives a gain inversely proportional to absolute temperature can be formed.

In the above constitution, the ratio of the resistance value of the first resistor to the resistance value of the second resistor is constant regardless of temperature changes.

In a typical preferred form, the first circuit and the second circuit each comprise transistors, diodes and resistors.

In another aspect of the present invention, the temperature characteristic compensating circuit comprises a first current source that supplies a first current that is proportional to absolute temperature and inversely proportional to a resistance value of a first resistor, a second current source that supplies a second current that is inversely proportional to a resistance value of a second resistor, a voltage-current converting circuit that converts an input voltage into a current, using a third resistor, and using the first current as a bias current, a logarithmic compression circuit that passes an output current from the voltage-current converting circuit through a diode, thus obtaining a logarithmically compressed voltage, a logarithmic expansion circuit that comprises a differential transistor using the second current as a bias current, and a current-voltage converting circuit that passes, through a fourth resistor, an output current obtained from the logarithmic expansion circuit by inputting an output from the logarithmic compression circuit into the logarithmic expansion circuit, thus obtaining an output voltage.

Preferably, the first, second, third and fourth resistors each have the same temperature characteristic.

Further, according to the present invention, there is provided a semiconductor integrated circuit having the temperature characteristic compensating circuit according to either of the aspects of the present invention.

The above and other objects, features and advantages of the present invention will become more apparent from the following detailed description taken in conjunction with the accompanying drawings.

DETAILED DESCRIPTION OF PREFERRED EMBODIMENTS

Figure 1:
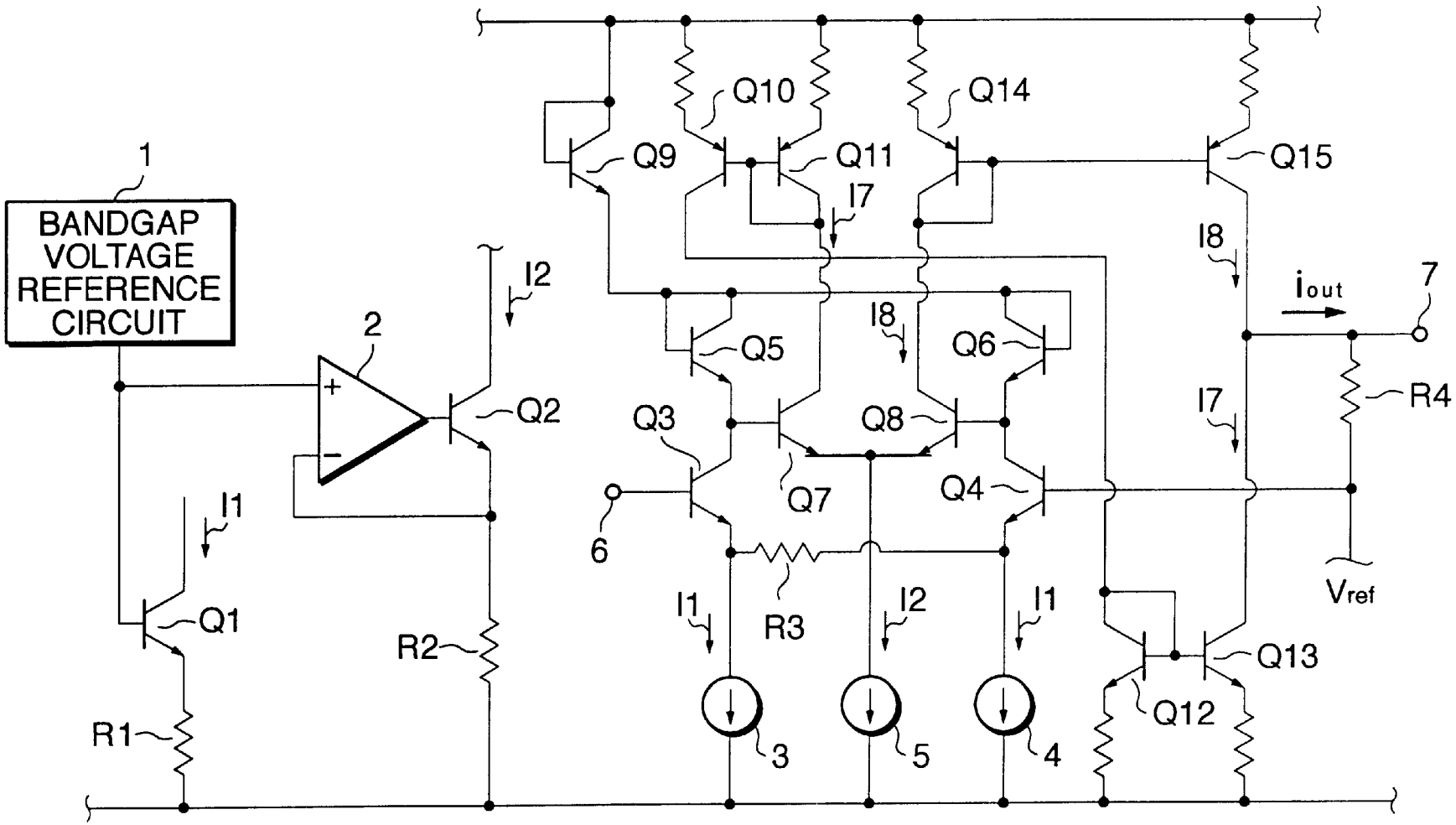
FIG. 1 is a circuit diagram showing the constitution of a temperature characteristic compensating circuit according to an embodiment of the present invention.
Figure 3:
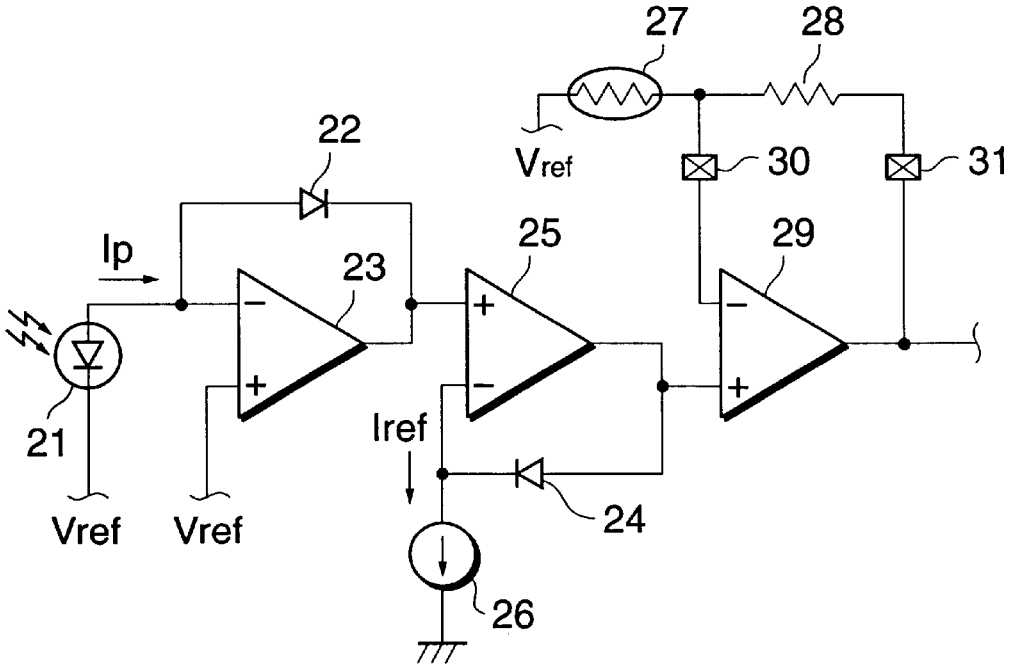
FIG. 3 is a circuit diagram showing an example of the constitution of a conventional temperature characteristic compensating circuit.

FIG. 1 is a circuit diagram showing the constitution of a temperature characteristic compensating circuit according to an embodiment of the present invention. The circuit shown in FIG. 1 is incorporated into an IC (semiconductor integrated circuit). In FIG. 1, reference numeral 1 designates a known bandgap voltage reference circuit, which outputs a constant voltage regardless of changes in temperature. Reference numeral 2 designates an operational amplifier, 3 and 4 current sources that supply, via a current mirror circuit not shown in FIG. 1, a current the same as the collector current I1 of a transistor Q1. Reference numeral 5 designates a current source that supplies, via a current mirror not shown in FIG. 1, a current the same as the collector current I2 of a transistor Q2. Reference numeral 6 designates an input terminal, through which is inputted a voltage that changes in proportion to the absolute temperature, for example an output from a photosensor after dark current compensation has been carried out (corresponding to the output from the operational amplifier 25 in FIG. 3). Reference numeral 7 designates an output terminal.

Figure 2:
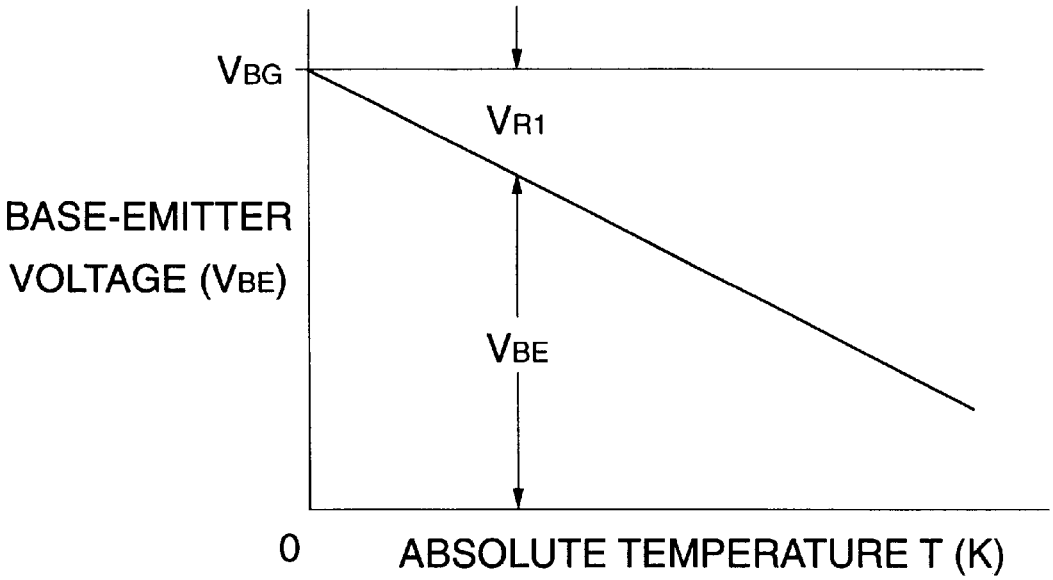
FIG. 2 is a graph showing the temperature characteristic of the base-emitter voltage $V_{BE}$ of a transistor Q1 appearing in FIG. 1.

As shown in FIG. 2, the base-emitter voltage $V_{BE}$ of the transistor Q1 is equal to the bandgap voltage $V_{BG}$ when the absolute temperature T=0(K), and then falls approximately linearly with increasing temperature. Thus, the emitter voltage of the transistor Q1, i.e. the voltage $V_{R1}$ across a resistor R1 (which has a temperature characteristic), is proportional to the absolute temperature T.

Representing the coefficient of proportionality between the voltage $V_{R1}$ across the resistor R1 and the absolute temperature T by A, the collector current I1 flowing through the transistor Q1 can be approximated as follows:

$$I1=A\times T/R1 \quad (1)$$

(Note that throughout this specification, 'R1' is used to refer both to the resistor and to the resistance value of the resistor; likewise for 'R2', 'R3' and 'R4' described below.)

Next, the voltage across a resistor R2 (which has a temperature characteristic) is equal to the bandgap voltage $V_{BG}$ because of an operational amplifier 2, and hence the collector current I2 flowing through the transistor Q2 is:

$$I2=V_{BG}/R2 \quad (2)$$

Let the input voltage inputted to the input terminal 6 be represented by $V_{in}$ relative to a reference voltage $V_{ref}$. A current of $V_{in}/R3$ thus flows through a voltage-current converting resistor R3 (which has a temperature characteristic) which is connected between the emitter of a transistor Q3 and the emitter of a transistor Q4. As a result, the input voltage $V_{in}$ is converted into a current. The currents flowing through the transistors Q5 and Q6, which are each shorted between the collector and base thereof and are thus each used as a logarithmically compressing diode, are therefore $I1+V_{in}/R3$ and $I1-V_{in}/R3$ respectively. The current $V_{in}/R3$ produced by converting the input voltage is thus added to the bias current I1, which is proportional to the absolute temperature T divided by the resistance R1 as shown in equation (1), in the transistor Q3, and the current $V_{in}/R3$ is subtracted from the bias current I1 in the transistor Q4. The currents with the current $V_{in}/R3$ added and subtracted flow through the transistors Q5 and Q6 respectively, and thus logarithmically compressed voltages are obtained. The logarithmically compressed voltage from the transistor Q5 is applied to the base of a transistor Q7, and the logarithmically compressed voltage from the transistor Q6 is applied to the base of a transistor Q8. Incidentally, a transistor Q9 is used as a diode to reduce the voltage applied to the transistors Q5 and Q6 by one diode's worth.

The transistors Q7 and Q8 constitute an emitter-coupled differential transistor that is driven by the bias current I2, which is inversely proportional to the resistance R2 as shown in equation (2). Letting the currents flowing through the transistors Q7 and Q8 be represented by I7 and I8 respectively, I7+I8=I2, and $I7:I8=(I1-V_{in}/R3):(I1+V_{in}/R3)$. This is because, as the current through the transistor Q5 increases, the voltage drop of the transistor Q5 increases, resulting in the base potential of the transistor Q7 falling and the current I7 falling, and at this time, the current through the transistor Q6 falls, and hence the voltage drop of the transistor Q6 falls, resulting in the base potential of the transistor Q8 rising and the current I8 rising. The logarithmically compressed voltages are thus converted by the transistors Q7 and Q8 into logarithmically expanded currents.

The current I7 flows through the collector of a transistor Q13 on account of a current mirror circuit composed primarily of transistors Q10 and Q11 and a current mirror circuit composed primarily of transistors Q12 and Q13. The current I8 flows through the collector of a transistor Q15 on account of a current mirror circuit composed primarily of transistors Q14 and Q15.

Letting the current flowing through a resistor R4 (which has a temperature characteristic) be represented by $i_{out}$, then because a current does not flow out from an output terminal 7:

$$i_{out}=I8-I7$$

Because I7+I8=I2 as described earlier:

$$I7=(I2-i_{out})/2$$

$$I8=(I2+i_{out})/2$$

Because $I7:I8=(I1-V_{in}/R3):(I1+V_{in}/R3)$ as described earlier:

$$(I1-V_{in}/R3):(I1+V_{in}/R3)=(I2-i_{out})/2:(I2+i_{out})/2$$

Solving this equation for $i_{out}$ gives as the output voltage $V_{out}$:

$$V_{out}=R4\times i_{out}=\{(R4\times I2)/(R3\times I1)\}\times V_{in}$$

From above-mentioned equations (1) and (2):

$$V_{out}=(V_{BG}/A)\times\{(R1\times R4)/(R2\times R3)\}\times(1/T)\times V_{in}$$

If the types of the resistors R1 to R4 are selected such that (R1×R4)/(R2×R3) is a temperature-independent constant, i.e. if resistors having the same temperature characteristic are selected as the resistors R1 to R4, then a temperature characteristic compensating circuit having a gain inversely proportional to the absolute temperature T can be realized.

Moreover, if this circuit is used downstream of a logarithmic compression circuit, then a temperature characteristic compensating circuit using an external thermistor and resistor becomes unnecessary, and hence the number of external terminals can be reduced.

It should be noted that, although the temperature characteristic compensating circuit of the present embodiment contains a bandgap voltage reference circuit, it is also possible to make a circuit having the same kind of properties by using current sources 3 to 5 having properties as described with reference to the present embodiment and inputting a constant voltage that does not vary with external temperature changes.

As described above, according to the circuit of the present embodiment, temperature compensation of a signal that varies in proportion to absolute temperature can be carried out by analog processing and without using a thermistor.

While the present invention has been particularly shown and described with references to preferred embodiments thereof, it will be understood by those skilled in the art that various changes in form and details may be made therein without departing from the scope of the invention encompassed by the appended claims.

What is claimed is:

1. A temperature characteristic compensating circuit comprising:

a first current source that supplies a first current that is proportional to absolute temperature and inversely proportional to a resistance value of a first resistor;

a second current source that supplies a second current that is inversely proportional to a resistance value of a second resistor;

a first circuit that carries out logarithmic compression of an input voltage, using the first current as a bias current; and a second circuit that carries out logarithmic expansion of the logarithmically compressed voltage, using the second current as a bias current;

wherein a gain of the logarithmically expanded voltage relative to the input voltage is proportional to a ratio of the second current to the first current.

2. A temperature characteristic compensating circuit as claimed in claim 1, wherein a ratio of the resistance value of the first resistor to the resistance value of the second resistor is constant regardless of temperature changes.

3. A temperature characteristic compensating circuit as claimed in claim 1, wherein said first circuit and said second circuit each comprise transistors, diodes and resistors.

4. A temperature characteristic compensating circuit comprising:

a first current source that supplies a first current that is proportional to absolute temperature and inversely proportional to a resistance value of a first resistor;

a second current source that supplies a second current that is inversely proportional to a resistance value of a second resistor;

a voltage-current converting circuit that converts an input voltage into a current, using a third resistor, and using the first current as a bias current;

a logarithmic compression circuit that passes an output current from said voltage-current converting circuit through a diode, thus obtaining a logarithmically compressed voltage;

a logarithmic expansion circuit that comprises a differential transistor using the second current as a bias current; and a current-voltage converting circuit that passes, through a fourth resistor, an output current obtained from said logarithmic expansion circuit by inputting an output from said logarithmic compression circuit into said logarithmic expansion circuit, thus obtaining an output voltage.

5. A temperature characteristic compensating circuit as claimed in claim 4, wherein said first, second, third and fourth resistors each have the same temperature characteristic.

6. A semiconductor integrated circuit comprising:

a first current source that supplies a first current that is proportional to absolute temperature and inversely proportional to a resistance value of a first resistor;

a second current source that supplies a second current that is inversely proportional to a resistance value of a second resistor;

a first circuit that carries out logarithmic compression of an input voltage, using the first current as a bias current; and a second circuit that carries out logarithmic expansion of the logarithmically compressed voltage, using the second current as a bias current;

wherein a gain of the logarithmically expanded voltage relative to the input voltage is proportional to a ratio of the second current to the first current.

7. A semiconductor integrated circuit, having:

a first current source that supplies a first current that is proportional to absolute temperature and inversely proportional to a resistance value of a first resistor;

a second current source that supplies a second current that is inversely proportional to a resistance value of a second resistor;

a voltage-current converting circuit that converts an input voltage into a current, using a third resistor, and using the first current as a bias current;

a logarithmic compression circuit that passes an output current from said voltage-current converting circuit through a diode, thus obtaining a logarithmically compressed voltage;

a logarithmic expansion circuit that comprises a differential transistor using the second current as a bias current; and a current-voltage converting circuit that passes, through a fourth resistor, an output current obtained from said logarithmic expansion circuit by inputting an output from said logarithmic compression circuit into said logarithmic expansion circuit, thus obtaining an output voltage.

* * * * *